US006796157B2

(12) United States Patent
Stalzer

(10) Patent No.: US 6,796,157 B2
(45) Date of Patent: Sep. 28, 2004

(54) MACHINE FOR FORMING CHEEK BENDS IN SHEET METAL

(75) Inventor: Leo H. Stalzer, Union, MO (US)

(73) Assignee: Lion Machinery, Inc., Pacific, MO (US)

( * ) Notice: Subject to any disclaimer, the term of this patent is extended or adjusted under 35 U.S.C. 154(b) by 0 days.

(21) Appl. No.: 10/374,842

(22) Filed: Feb. 26, 2003

(65) Prior Publication Data

US 2003/0159490 A1 Aug. 28, 2003

Related U.S. Application Data

(60) Provisional application No. 60/359,851, filed on Feb. 27, 2002.

(51) Int. Cl.[7] ..... B21D 5/04
(52) U.S. Cl. ..... 72/319
(58) Field of Search ..... 72/319–321, 388

(56) References Cited

U.S. PATENT DOCUMENTS

| | | | | | |
|---|---|---|---|---|---|
| 312,547 | A | * | 2/1885 | Andersen | 72/319 |
| 1,030,259 | A | * | 6/1912 | Wells | 72/319 |
| 1,713,964 | A | | 5/1929 | Hoff et al. | |
| 1,785,537 | A | * | 12/1930 | Stevens | 72/314 |
| 2,722,858 | A | | 11/1955 | Oyen | |
| 3,731,514 | A | | 5/1973 | Deibele, Jr. | |
| 3,815,393 | A | * | 6/1974 | Daniels | 72/6.1 |
| 3,875,784 | A | * | 4/1975 | Daniels | 72/320 |
| 3,946,588 | A | * | 3/1976 | Mayston | 72/466.8 |
| 3,983,735 | A | | 10/1976 | Berry | |
| 4,014,200 | A | | 3/1977 | Wolters | |
| 4,185,487 | A | | 1/1980 | Merideth | |
| 4,242,898 | A | | 1/1981 | Salvagnini | |
| 5,497,643 | A | | 3/1996 | Koch et al. | |
| 5,802,906 | A | | 9/1998 | Lillbacka et al. | |
| 5,934,133 | A | | 8/1999 | Takahashi et al. | |
| 6,038,909 | A | * | 3/2000 | Zink | 72/319 |

FOREIGN PATENT DOCUMENTS

| | | | | |
|---|---|---|---|---|
| DE | 1452919 | * | 4/1971 | 72/319 |
| FR | 2686533 | * | 7/1993 | 72/319 |
| JP | 46785 | * | 12/1978 | 72/319 |
| NL | 8203340 | * | 3/1984 | 72/319 |

* cited by examiner

*Primary Examiner*—Daniel C. Crane
(74) *Attorney, Agent, or Firm*—Polster, Lieder, Woodruff & Lucchesi, L.C.

(57) ABSTRACT

A center-less sheet metal bending machine is provided to form cheek bends in a piece of sheet metal. The bending machine includes a housing having a mouth and a table adjacent the housing mouth. A clamping mechanism is provided to hold the sheet metal in place during a bending operation, and a bending mechanism is provided to form a cheek bend in the sheet metal. The clamping mechanism includes a toggle or link driven anvil which is movable between a raised and a lowered position. The bending mechanism includes an elongate bending bar which is mounted in the housing for rotation between a start position and a finished position. In the start position, a forward edge of the bending bar is proximate a rear edge of the anvil. The bending bar is pulled rearwardly and upwardly to rotate it from its start to its finished position to form a bend in a piece of sheet metal.

8 Claims, 7 Drawing Sheets

MACHINE FOR FORMING CHEEK BENDS IN SHEET METAL

CROSS-REFERENCE TO RELATED APPLICATIONS

This application claims priority to Provisional Application No. 60/359,851 filed Feb. 27, 2002, entitled Sheet Metal Bending Machine, and which is incorporated herein by reference.

STATEMENT REGARDING FEDERALLY SPONSORED RESEARCH OR DEVELOPMENT

Not Applicable.

BACKGROUND OF THE INVENTION

This invention relates to sheet metal bending machines, and, in particular, to an open center or center-less cheek bender or sheet metal bending machine used to bend small edges or lips on metal pieces, such as are typically used in metal ductwork.

Sheet metal bending machines generally have shafts which drive the element which bends the sheet metal. The use of such shafts prevents such bending machines from being used to bend sheet metal which has a length greater than the length of the opening of the sheet metal bending machine. Hence, the length of sheet metal which can be bent by such current machines is limited by the size of the opening into the machine.

BRIEF SUMMARY OF THE INVENTION

A sheet metal bending machine is provided to form cheek bends in a piece of sheet metal. The bending machine includes a housing having a mouth and a table adjacent the housing mouth. Preferably, the table extends into the mouth to support the sheet metal inside the mouth. A clamping mechanism is provided to hold the sheet metal in place during a bending operation, and a bending mechanism is provided to form a cheek bend in the sheet metal.

The clamping mechanism includes an elongate anvil positioned above the table and which is movable between a raised position in which sheet metal can be inserted in the clamping mechanism and a lowered position in which sheet metal is clamped between said anvil and said table. To move the anvil between its raised to its lowered positions, the clamping mechanism includes an upper link pivotally mounted to the housing and a lower link pivotally connected to a lower end of the upper link. The anvil is operatively and pivotally connected to a lower end of the lower link. The upper and lower links are pivoted relative to each other by a drive (such as a foot pedal operated cable) to be moved from an angled position to a position in which the lower link is substantially aligned with at least a part of the upper link, and in fact, the two links are pivoted to a position slightly over center to lock the anvil in its lowered position. To unlock the links, and allow the anvil to be moved to its raised position, the bending mechanism operatively engages the links to move the links back over center. A spring mechanism then raises the anvil.

In one embodiment, an arm extends from the bending mechanism and a finger extends from the arm. When a bend is complete, the finger engaging the links proximate their pivot point to push the pivot point back to unlock the links. In a second embodiment, the upper link is angled and includes an upper section and a lower section joined at an angle. This angle defines the pivot point for the upper link.

An arm extends from the upper link, and is sized and positioned relative to the link upper portion such that when the anvil is in its lowered position, the arm engages the bending mechanism. In this embodiment, the bending mechanism pushes up against the arm when a bending operation is complete to unlock the links and to allow the anvil to return to its raised position.

The bending mechanism comprising an elongate bending bar which is mounted in the housing to be pivotal between a start position in which the bending bar is substantially parallel to the table and a finished position in which the bending bar is pivoted upwardly. The bending bar is pivoted or rotated by a drive. The bending bar is positioned, such that when the bending bar is in its start position and the anvil is in its lowered position, a forward edge of the bending bar is proximate a rearward edge of the anvil. In one embodiment, the bending bar is mounted at its opposite ends to discs. The housing includes openings sized to rotatably receive the discs. The drive including a chain which is operatively connected to the bending bar such that when the chain is pulled, the chain causes the bending bar to pivot. Preferably, the discs do not form a complete circle. In this embodiment, the anvil is horizontally and vertically positioned such that the rear edge of the anvil is approximately aligned with the center of the housing openings.

In another embodiment, the machine includes a curved track which extends around the housing mouth. The track defines a path of travel for the bending bar. Preferably, the bending bar is mounted to a block, and one of the block and said track have a groove, and the other has a rib. The rib is received in the groove.

BRIEF DESCRIPTION OF THE SEVERAL VIEWS OF THE DRAWINGS

Corresponding reference numerals will be used throughout the several figures of the drawings. For purposes of clarity, not all parts of the machine are shown in each drawing.

DETAILED DESCRIPTION OF THE INVENTION

Figure 1:
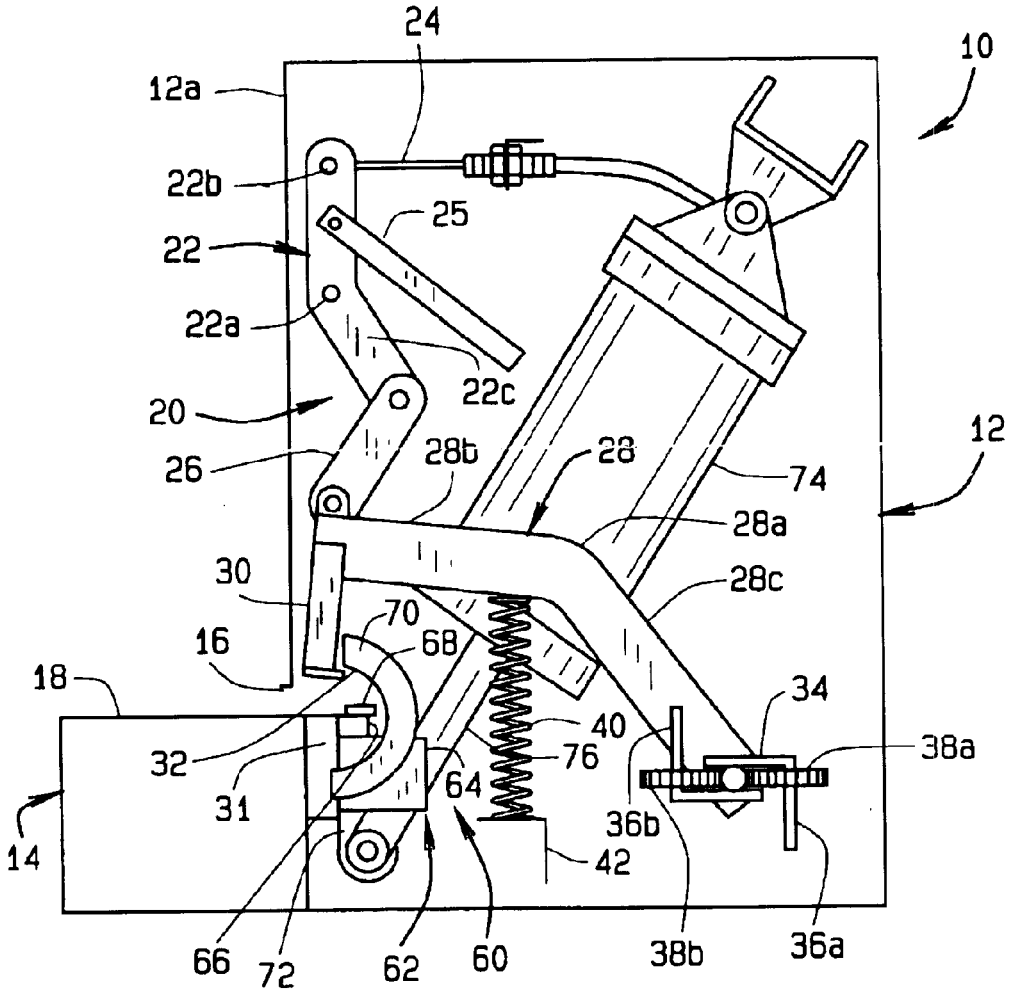
FIG. 1 is a sectional view of a first illustrative embodiment of the cheek bender of the present invention in an opened position.

The following detailed description illustrates the invention by way of example and not by way of limitation. This description will clearly enable one skilled in the art to make and use the invention, and describes what I presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

An illustrative embodiment of a cheek bender or sheet metal bending machine 10 is shown in FIG. 1 in a start or open position in which the machine is ready to receive sheet metal to form a bend or lip at the edge of the sheet metal. The machine 10 includes a housing 12 and a table 14 extending from the housing. The housing has an opening 16 extending the width of the machine to admit a sheet metal edge into the machine to be bent. The table 14 has an upper surface 18 which is level or even with the bottom of the opening 16. A clamping assembly 20 and bending assembly 60 are contained within the housing to clamp and bend the sheet metal.

The clamping assembly 20 includes a toggle 22 which is pivotally mounted to the housing, and is substantially centered relative to the housing. The toggle 22 is bent at its center 22*a* about which the toggle pivots. The toggle center 22*a* divides the toggle into an upper section 22*b* and a lower section 22*c*. A cable 24 is connected at one end to the toggle upper section 22*a*, and at a second end to a foot pedal (not shown). A toggle finger 25 is fixed to the toggle upper section 22*b*, between the toggle pivot point 22*a* and the end of the upper section 22*b*.

Figure 2:
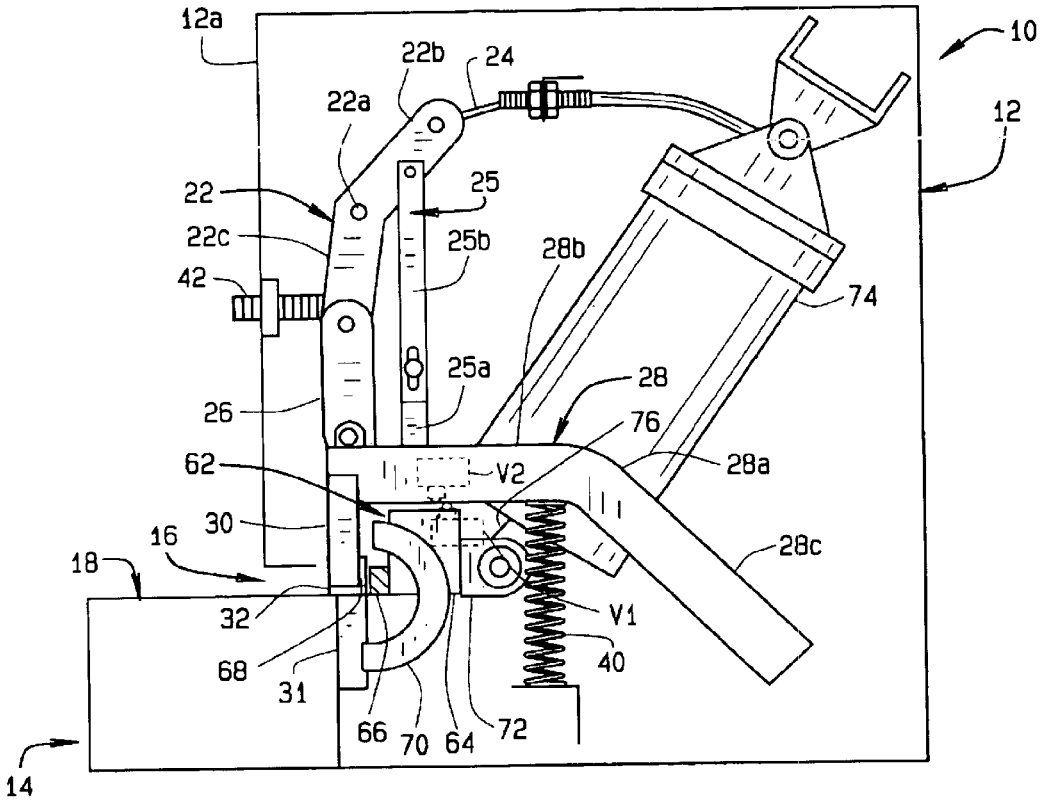
FIG. 2 is a sectional view of the cheek bender in a closed position.

A pair of links 26 are pivotally connected at one end to the toggle bottom section 22*c*. The links 26 are positioned on opposite sides of the toggle 22. A pair alignment arms 28 are pivotally connected to the opposite end of the links 26, and a hold down bar 30 extends downwardly from the alignment arm 28. The hold down bar 30 includes an anvil or foot 32 around which the metal is bent at the bottom of the hold down bar 30. The foot 32 preferably extends beyond the back edge of the hold down bar 30. A bed 31 is positioned below the hold down bar 30 just inside of the machine opening 16. As can be seen, the bed surface is co-planar with the table surface 18 and is sized, such that its back surface is substantially flush with the back surface of the foot 32, when the hold down bar and foot are lowered, as seen in FIG. 2.

The toggle 22, link 26, and hold down bar 30 extend along the forward edge 12*a* of the housing 12. When the machine is in its start or open position, the hold down foot 32 is raised above the top of the housing opening 16. When the foot pedal is depressed, the cable 24 is pulled. The cable 24 thus pulls the toggle top section 22*b* rearwardly, causing the toggle bottom section 22*c* to attain a generally vertical orientation. The pivoting of the toggle 22 around its pivot point 22*a* thus pushes the link 26 downwardly until it also attains a generally vertical orientation. The movement of the link 26 moves the hold down bar 30 downwardly to a point where the hold down bar will clamp the sheet metal to be bent between the hold down bar foot 32 and the bed 31. The height of the toggle 22 and link 26 above the bed 31 are adjustable to insure good clamping of the metal sheet between the hold down bar foot 32 and the bed 31. The length of the cable 24 is adjusted, such that when the sheet metal is clamped, the junction between the toggle 22 and link 26 will be pivoted to a point just over center, as seen in FIG. 2.

The alignment arms 28 extend rearwardly from the hold down bar 30. The alignment arms are bent, as at 28*a*, and include a forward section 28*b*, which is connected to the link 26 and the hold down bar 30, and a rear section 28*c*. In the start position, the arm rear section extends diagonally rearwardly and downwardly. The arm rear section 28*c* is pivotally mounted in the housing at the back end of the arm rear section. A pin 34 extends through the arm rear section 28*c* at its back end and defines the pivot point for the arms 28. The pin is held between a pair of L-brackets 36*a,b* (FIG. 1) which are mounted in the housing in an overlapping relationship to define a channel between opposing legs of the brackets. The pin 34 is received in this channel, and bolts 38*a,b* pass through threaded openings in legs of the brackets to bear against the pin 34. The position of the bolts 38*a,b* can be adjusted to adjust the position of the alignment arm 28, and hence the horizontal position of the hold down bar 30. Thus, the position of the hold down bar 30 can be adjusted to insure that the hold down bar foot 32 is at the center of rotation of the bending member, as will be described below.

Two springs 40 are mounted at their bottom ends to a bracket 42, and at their top ends, the springs are operatively connected to the forward potion of the alignment bars 38, there being one spring 40 for each alignment bar 28. The bracket 42 can be one elongate bracket, or two discrete brackets. When the toggle 22 and link 26 are straightened out to lower the hold down bar, the alignment bars will also be lowered, and the springs 40 will be compressed. After the sheet metal is bent, the toggle and link are released, and, as the bending bar retracts, the springs 40 urge the arms 28 upwardly to raise the hold down bar.

The bending assembly 60 includes a bender 62 comprising a pair of spaced apart blocks 64 with a bar 66 mounted to the upper surface of the blocks and extending across the opening 16 of the machine 10. In the open position, as seen in FIG. 1, the top surface of the bar 66 is substantially level with the surface of the bed 31 and the table surface 18. A back gauge 68 on the upper surface of the bar 66 has a front edge that is set back from the front edge of the bar 66. As can be appreciated, when sheet metal is passed through the opening 16 of the housing 12, the sheet metal will rest on the bed 31 and the bar 66. The back gauge 68 acts as a stop to prevent the sheet metal from being inserted too deeply into the machine 10 to control the size of the lip formed on the sheet metal.

To bend the sheet metal, the bender 62 travels about a curved track 70. The block 64 has a curved groove (not shown) in its side which travels on the track 70 to allow the block to travel along the track. Alternatively, the track 70 could be provided with a groove, and the block could be provided with a curved rib which engages the groove in the track. An arm 72 extends from the bottom of the bar 66.

A cylinder 74 having a piston rod 76 is pivotally mounted in the housing. The piston rod 76 is pivotally connected to the arm 72 to move the bar 66, and hence the block 64 about the track 70 as the piston rod is reciprocated. The cylinder 74 is preferably a pneumatic cylinder, and extension and retraction of the piston rod 76 is controlled by altering the flow of hydraulic fluid through the cylinder. Preferably, the direction of flow of the hydraulic fluid is controlled by a spool valve; and the position of the spool valve is controlled by a pair of pneumatic limit valves V1 and V2. To avoid conflict with the toggle 22, the cylinder is preferably positioned off-center relative to the machine opening 16. When the machine 10 is in the open position, the piston rod 76 is extended, as shown in FIG. 1, and the bender bar 66 is substantially co-planar with the bed 31 and table surface 18.

As the piston rod 76 is retracted, the rod 76 pulls the bender 60 about the track 70. The bender bar 66 is sized and positioned such that its top, forward edge is substantially at the center of the circle defined by the track 72. Similarly, the hold down bar 30 is positioned, using the adjusting screws 36*a,b* such that the back edge of the foot 32 is substantially at the center of the circle defined by the track 72.

In operation, the foot pedal is depressed to straighten out the toggle 22 and link 26 to lower the hold down bar 30 and clamp the sheet metal between the hold down bar foot 32 and the bed 31. As noted above, the toggle 22 and link 26 are moved to a position which is slightly over center. In this over center position the springs 40 cannot move the alignment arms 28 upwardly to unclamp the sheet metal. Hence, the toggle 22 and link 26 are in a locked position. An adjustment screw or bolt 42 (FIG. 2) is provided to prevent the toggle 22 and link 26 from bending over too far past the over center position. The adjustment screw 42, which is mounted in a threaded opening in the machine body (for example, in a nut) is adjusted such that the elbow or joint between the toggle 22 and link 26 contacts the bolt 42 when the joint is just over center, as seen in FIG. 2. When the sheet metal is clamped in position, the first, or bending, limit valve V1 is contacted to direct the flow of hydraulic fluid through the cylinder 74 to retract the piston rod 76 and pull the bender around the track 70 to bend the sheet metal. The bending limit valve V1 is shown to be contacted by the alignment bar 28. However, it can be positioned so that it is contacted or activated by the toggle 22, the link 26, or the hold down bar 30.

When the bending limit valve V1 is activated, the cylinder 74 is activated to retract the cylinder rod 76 to pivot the bender assembly 60 around the track 70. When the bending assembly 60 has been rotated 90°, the back gauge 68 is positioned to be above the top surface of the hold down bar foot 32.

The toggle finger 25 is sized and positioned relative to the toggle upper portion 22*b* such that when the machine 10 is in its closed position, it engages the block 64. Preferably, the toggle finger 25 is adjustable, and includes a lower portion 25*a* that is slidably connected to an upper portion 25*b*. The upper and lower potions can be connected by a nut and bolt which extends through an elongate slot. The toggle finger 25 can be made to be adjustable in length by other conventional means as well, which are known in the art.

As the bending assembly 60 completes is downward travel (i.e., as it is pivoted from the position shown in FIG. 1 to the position shown in FIG. 2), the bender block 64 will contact and push up against the toggle finger 25. The upward motion of the toggle finger 25 will push upwardly against the toggle upper portion 22*b*. This action cause the toggle 22 and the link 26 to pivot relative to each other to move the junction between the two back over center, to release the toggle and link from their locked position. To enable the toggle and link to be released from the locked position, the release finger 25 is adjusted to have a length such that it will be contacted, and moved, by the bender block 64, as the bender block completes its 90° pivot. When the toggle 22 and link 26 are released, the spring 40 pushes upwardly against the alignment arm 28 to raise the hold down bar 30 to its raised position.

When the bender 62 reaches a pre-set point (for example, when the sheet metal has been bent to 90°), the second or reversing limit valve V2 is activated to reverse the motion of the piston rod to return the bender 62 to its start position, as shown in FIG. 1. This preferably occurs after the toggle and link have been released from their locked position. Hence, as can be appreciated, the toggle 22 and link 26 are released from their locked position concurrently with, or just prior to, activation of the reversing limit valve V2; and hence, prior to extension of the piston rod.

Figure 3:
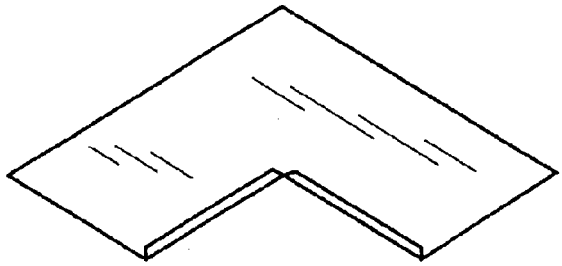
FIG. 3 is an isometric view of a piece of sheet metal bent using the cheek bender of the present invention.

The opening 16 to the machine 20 extends across the front surface 12*a* of the machine housing 12. Nothing blocks the opening 16 along the sides of the machine 10. Hence, the machine is an open center or center-less bending machine. This allows for making bends at right angles to each other, as seen in FIG. 3. Additionally, bends longer than the width of the machine may be made by notching the edge to be bend, and then bending the edge in sections. Additionally, the use of the foot pedal for activation of the metal bending machine eliminates the need for a separate cylinder and valves to move the table bar 40.

Figure 4:
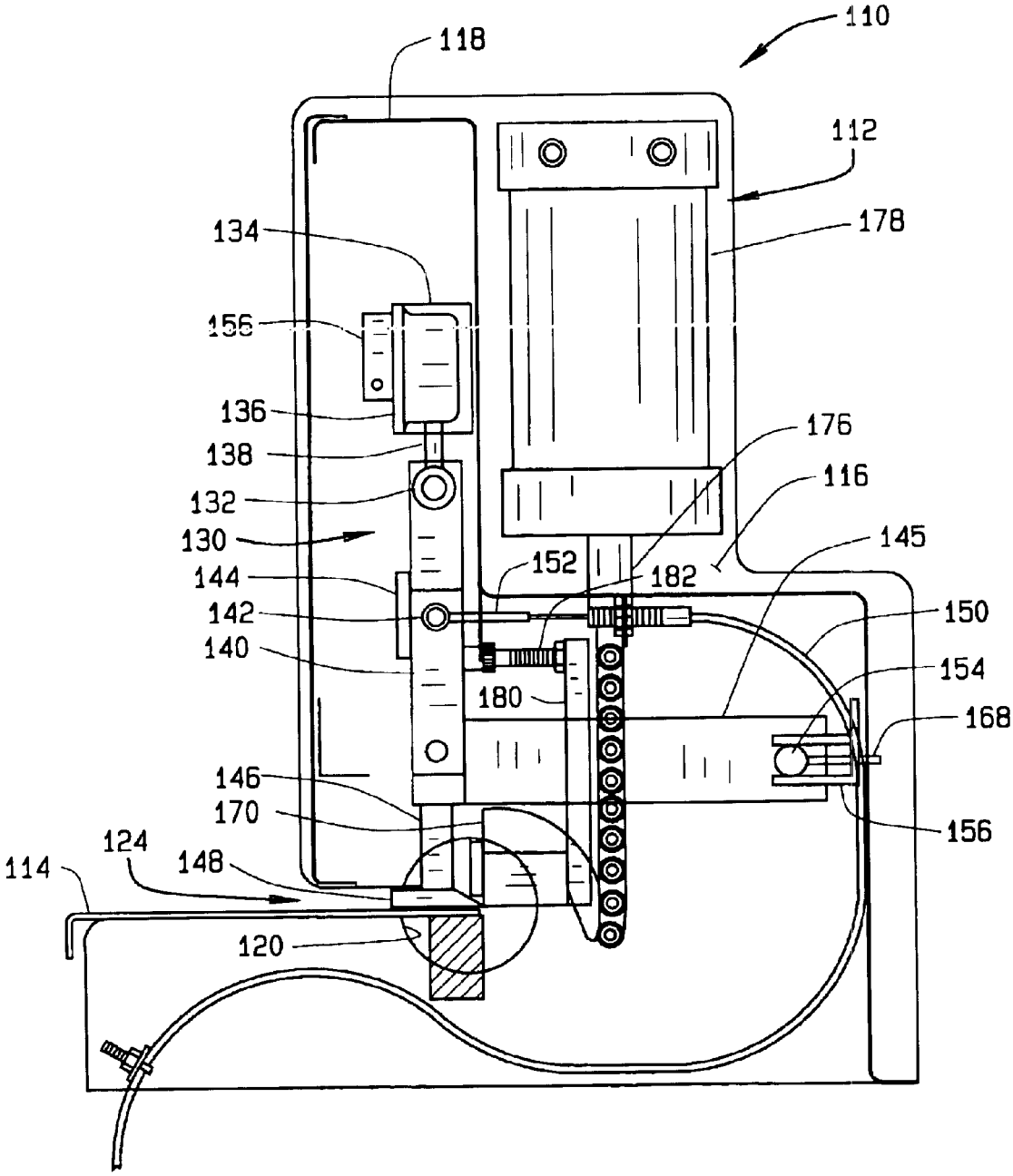
FIG. 4 is sectional view of a second illustrative embodiment of a cheek bender of the present invention in a closed position.

A second embodiment of the cheek bending machine is shown in FIGS. 4–11. The cheek bending machine 110 includes a housing 112 (FIG. 8) and a table 114 extending from the housing. The housing 112 includes a pair of side panels 116 mounted on a frame 118 (FIG. 4). The side panels 116 each have a circular opening 120 (FIG. 8), the diameter of which is substantially co-planar with the table 114. The table 114 extends to the approximate center of the opening 120. The side panels 116 each include a slot 122 extending rearwardly from the front of the panel to the circular opening. The slot 122 is aligned with a mouth 124 (FIG. 4) of the bending machine through which a piece of sheet metal can be inserted into the machine. Hence, the mouth 124 is open at its sides. Thus, the machine 110 can accept sheet metal having a width greater than the width of the machine 110.

Figure 5:
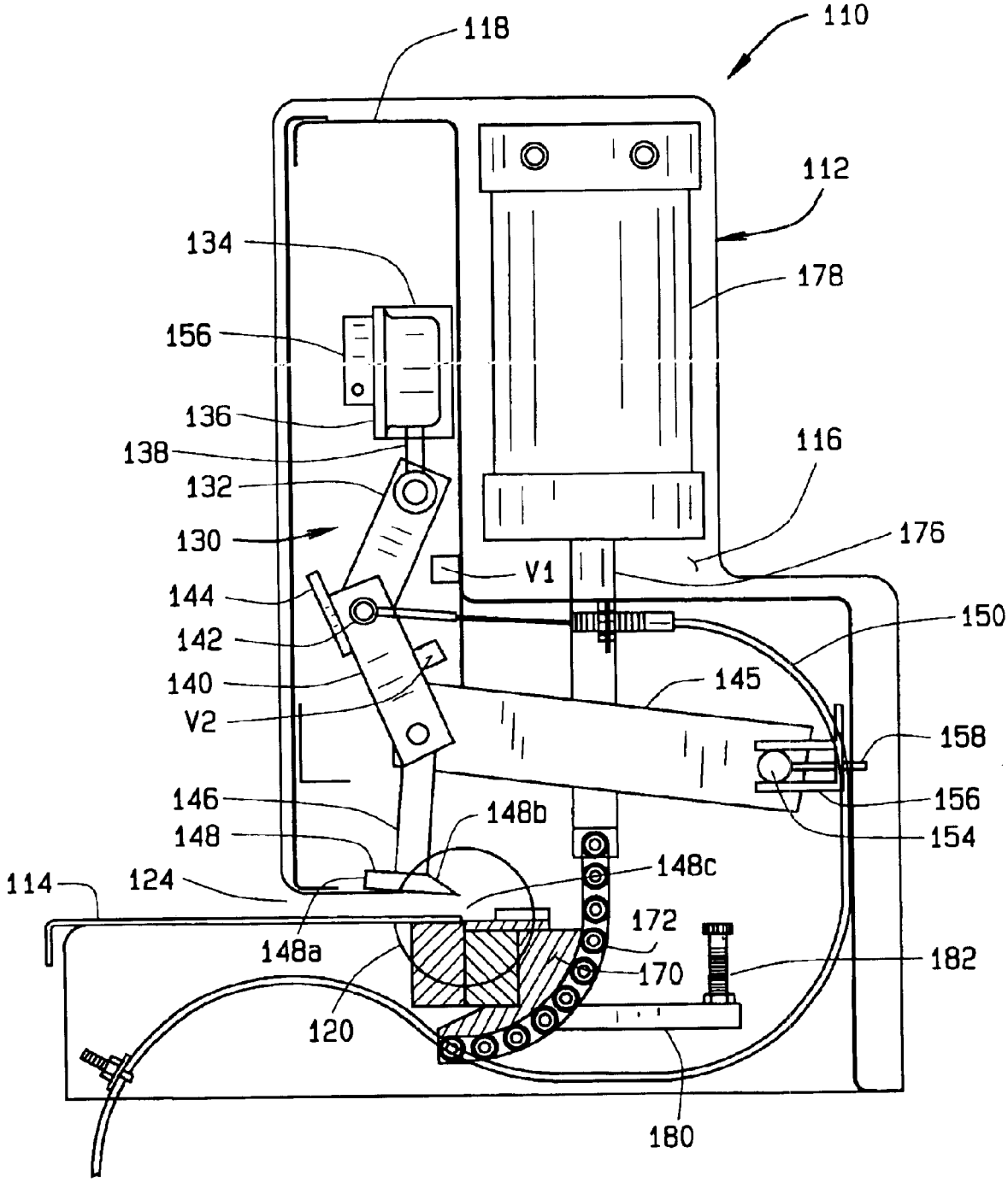
FIG. 5 is view similar to the view of FIG. 4, but in the opened position.

The bending machine 110 includes a clamping mechanism 130 and a bending mechanism 160. The clamping mechanism (shown in FIGS. 4 and 5) includes an upper link 132 which is pivotally connected to the frame 118 at an upper end of the link 132. Preferably, a the frame includes a C-channel 134 which is closed by a plate 136. An eye-bolt 138 is mounted in the bottom of the C-channel 134, and the link 132 is pivotally connected to the eye-bolt. The eye-bolt is mounted in the channel so that its position can be adjusted if desired. A lower link 140 is pivotally connected at its upper end to the lower end of the link 132, at a pivot point or elbow 142. A toggle stop bar 144 is mounted to the top of the lower link 140 and extends above the lower link 140 to traverse the junction between the upper and lower links 132 and 140 when the clamping mechanism is in the closed position as seen in FIG. 4. A horizontal positioning adjustment bar 145 is pivotally connected to the bottom of the lower link 140. The adjustment bar 145 is oriented in a generally horizontal position, is connected to the lower link 140 at its front end, and extends rearwardly through the housing. A hold down bar 146 is mounted to the bottom of the adjustment bar 145 at the front of the adjustment bar. The hold down bar 146 is normal to the adjustment bar 145 and spans substantially the full width of the machine's mouth 124. Lastly, a nose bar 148 is fixed to the bottom of the hold down bar 146. The nose bar 148 is generally trapezoidal in side elevational view, as seen in FIGS. 4 and 5. The nose bar 148 has a generally vertical front surface 148*a* and a sloped or beveled rear surface 158*b*, which comes to a point 148*c*. As will be discussed below, the nose bar 148 defines an anvil for the sheet metal bending operation.

The clamping mechanism is operated by a foot pedal (not shown) which, when depressed, pulls upon a cable 150. The cable 150 is connected to the pivot point 142 between the links 132 and 140 by a connecting rod 152. As can be seen by comparing FIGS. 4 and 5, when the cable 150 is pulled, the pivot point (or elbow) 142 of the links 132 and 140 is pulled rearwardly to bring the two links into a substantially parallel and vertical orientation, as seen in FIG. 4. A pair of return springs 154 (FIG. 9) are provided to raise the hold down bar and nose bar to the open position shown in FIG. 5. The springs 154 are preferably mounted at one end to a spring mounting clip 156 on the C-channel cover plate 136, and at an opposite end, to either the hold down bar or the nose bar.

The clamping mechanism is vertically positioned such that, when it is in the closed position (shown in FIG. 4), a pieced of sheet metal will be firmly held in place between the bottom of the nose bar 148 and the top of the table 114. The adjustable eyebolt allows for vertical adjustment of the nose bar simply by altering the amount the eyebolt is threaded into the C-channel 134.

Figure 10:
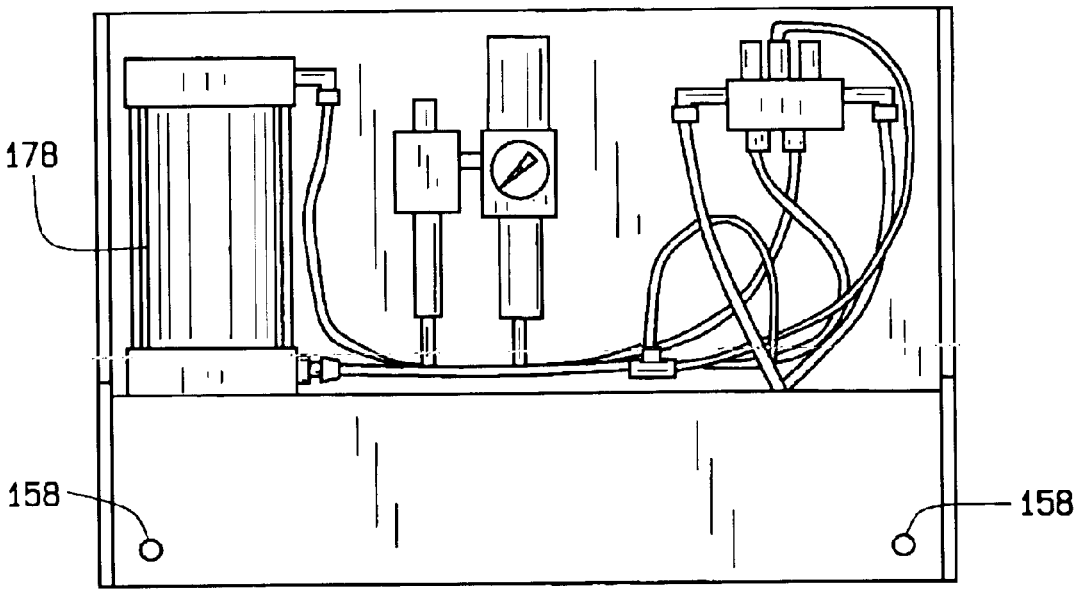
FIG. 10 is a rear elevational view of the machine.
Figure 11:
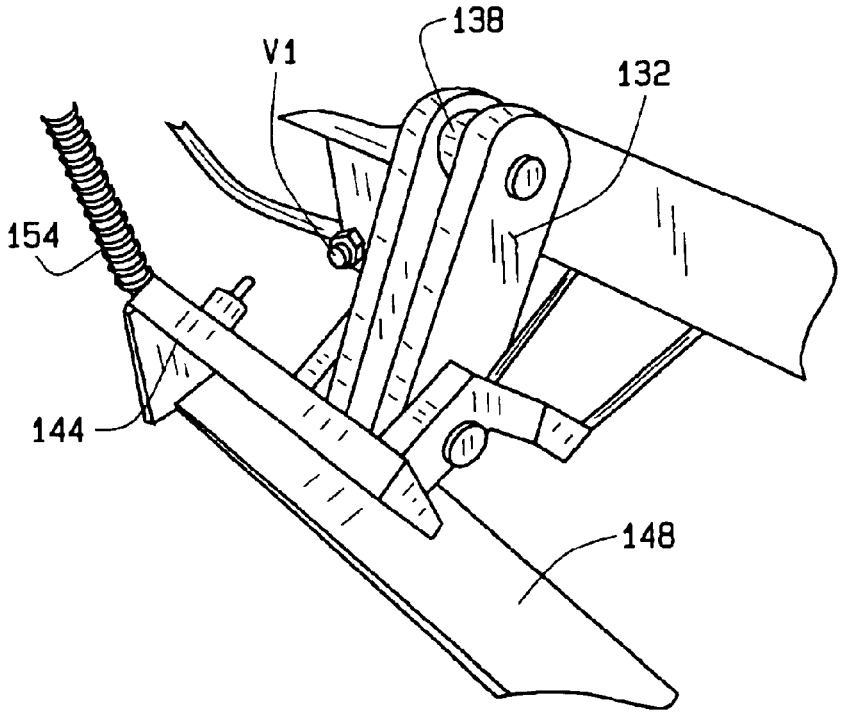
FIG. 11 is an enlarged perspective view of the hold down mechanism.

The clamping mechanism is horizontally positioned such that the tip 148*c* of the nose bar 148 is substantially aligned with the center of the side panel opening 120 when the clamping mechanism is closed, as seen in FIG. 4. The horizontal position of the nose bar 148 is adjusted using the horizontal adjustment bar 145. The adjustment bar 145 pivots about an axle 154 near the rear of the adjustment bar 145. The axle is slidably mounted in a horizontal guide track 156. A pair of adjustment screws 158 (FIGS. 4 and 10) extend through the rear of the housing 112 and into the adjustment bar 145. The screws 158 are accessible externally of the housing, as seen in FIG. 10, and, by rotating the screws 158, the position of the pivot axle 154 along the guide track 156, and hence, the horizontal position of the nose bar point 148*c* can be properly positioned.

Figure 6:
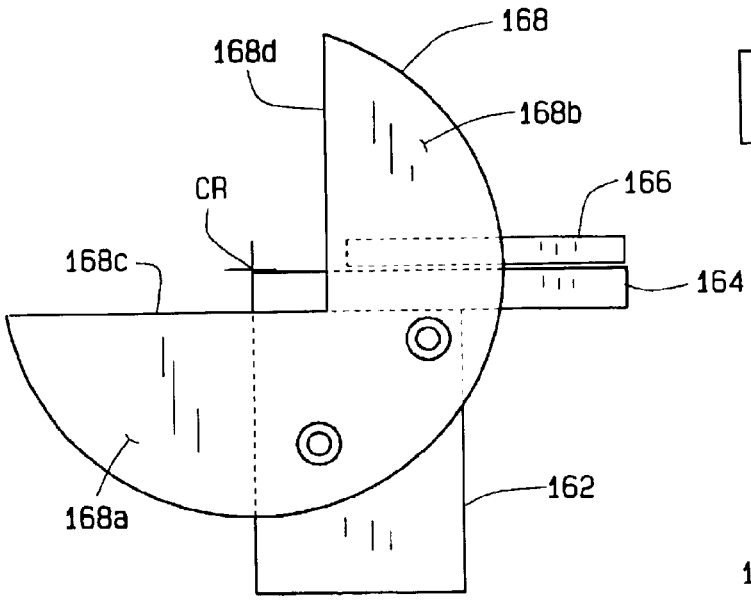
FIG. 6 is an enlarged view of a bending bar and bearing assembly.
Figure 7:
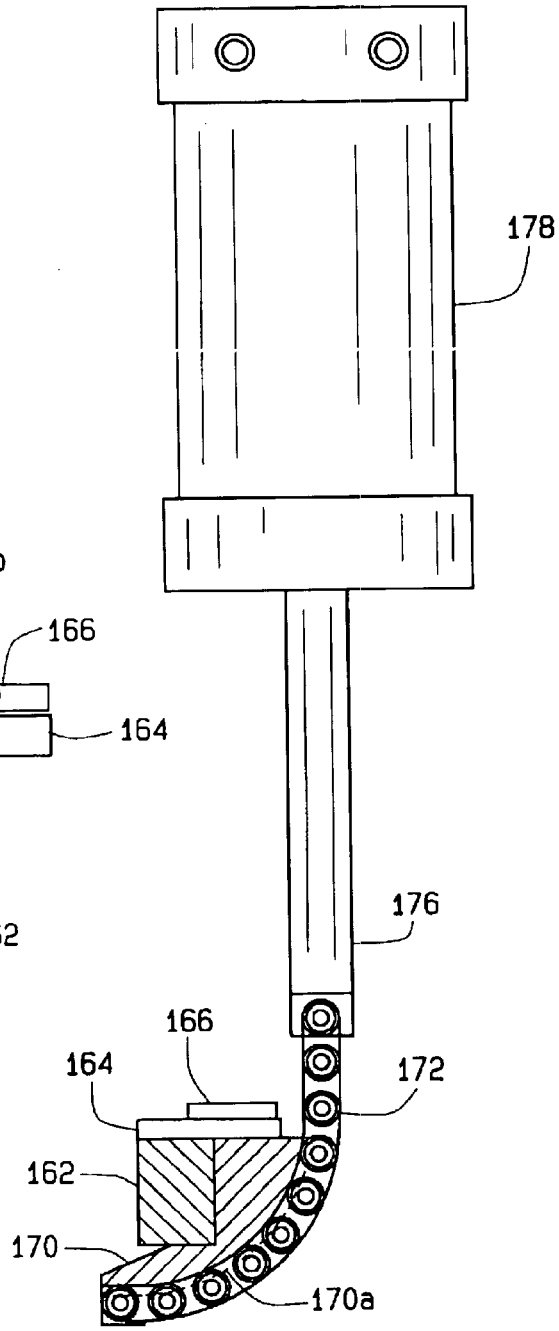
FIG. 7 is an enlarged view of the drive for rotating the bending bar.
Figure 8:
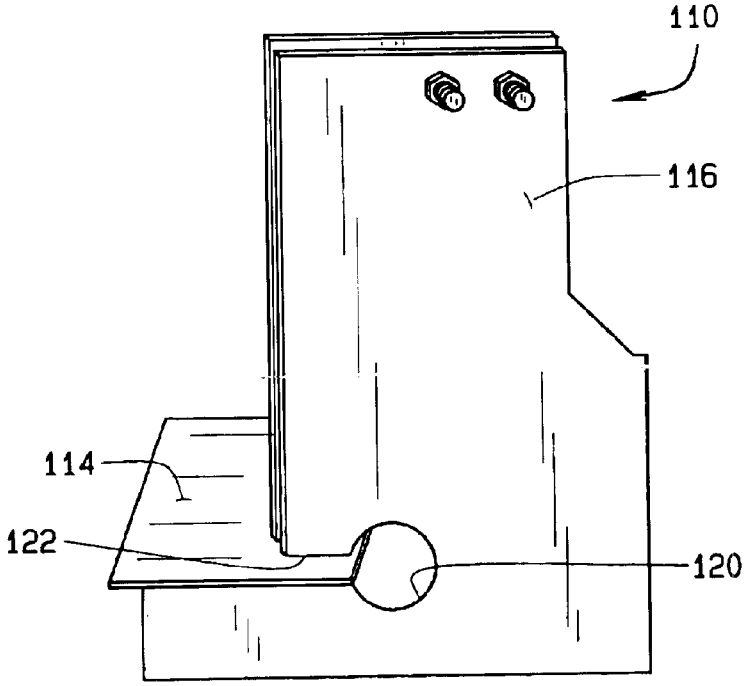
FIG. 8 is a side view of the machine.
Figure 9:
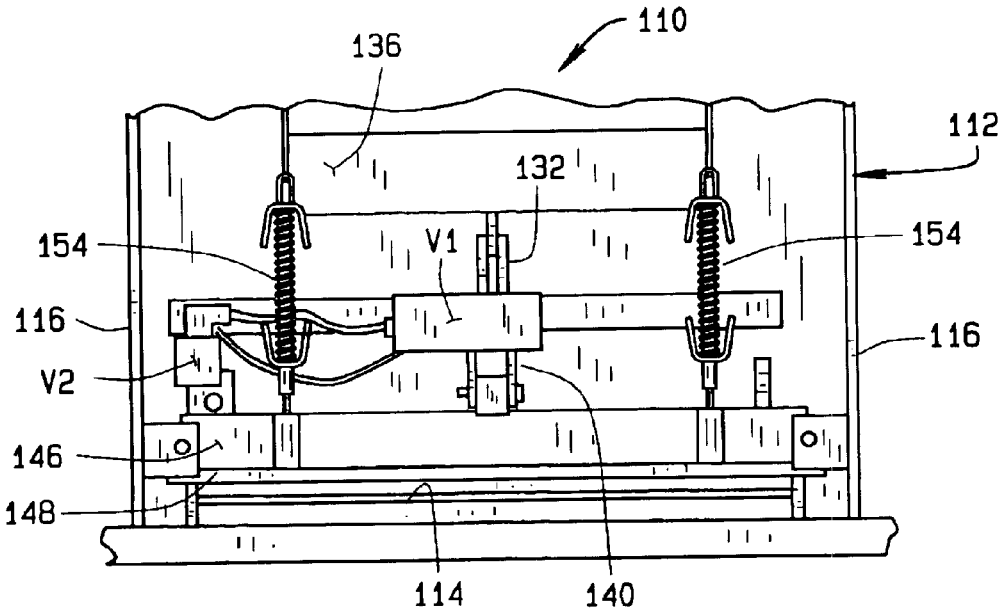
FIG. 9 is a front view of the machine.

Turning to FIGS. 6 and 7, the bending mechanism 160 includes a generally rectangular bending bar 162. A bending bar table 164 is mounted on top of the bending bar 162 such that the front surfaces of the table 164 and the bar 162 are substantially flush with each other. A stop 166 is mounted to the top of the table 164 such that its front edge is spaced rearwardly of the front surfaces of the table 164 and bar 162. Preferably, the position of the stop 166 on the table 164 can be adjusted. The bending bar 162 is mounted, at its opposite ends, to discs 168. The discs 168 have a curvature or diameter sized to allow the discs 168 to fit in and freely rotate within the housing side panel openings 120. To facilitate rotation of the discs 168 in the housing openings, the discs are made of either bronze or steel. Of course, any other material that can withstand the stresses to which the discs 168 will be exposed, and which will allow for smooth rotation of the discs in the hosing openings, can be used as well. The discs 168 do not define a complete circle. Rather, they define a lower section 168*a* and an upper section 168*b*. The lower section 168*a* forms slightly less than a semicircle. The upper surface 168*c* of the lower section 168*a* is flush with the top surface of the bending bar 162, and the bending bar 162 is fixed to the disc lower section, for example, by means of mounting bolts. The disc section 168*a* and the bending bar table 164 are sized such that the forward upper corner of the bending bar table will be at the center of rotation CR of the disc 168. The disc upper section 168*b* defines a truncated quarter circle having a forward edge 168*d* which is normal to the disc surface 168*c* and spaced rearwardly of the center of rotation CR. As can be seen in FIG. 5, the shape of the disc leaves the mouth 124 opened so that sheet metal which is wider than the machine 110 can be inserted in the machine to be bent.

As seen, the bending bar 162 extends beyond the perimeter of the disc 168. The bending bar 162 extends substantially the width of the machine 110. Thus, when the discs 168 are received in the side panel openings 120, the bending bar, when mounted to the discs, will prevent undue lateral motion of the bending bar/disc assembly, and no special mounting arrangement is required to maintain the bending bar/disc assembly in place in the machine 110. As can be appreciated, this arrangement allows for simple construction of the machine 110 as well as for easy servicing of the machine 110.

As can be seen in FIGS. 4 and 5, when sheet metal is inserted into the bending machine mount 124, the sheet metal will engage the stop plate 166. When the clamping mechanism is closed, and the bending mechanism is in the start position, the nose bar point 148*c* is in close proximity to the center of rotation CR of the disc 168, and hence of the bending bar and bending table. To form a bend or cheek in the sheet metal, once the clamping assembly is closed, the bending bar is rotated about the center of rotation. Thus, the nose bar in effect is an anvil and the size of the cheek that is formed is defined by the distance the stop plate 166 is set back on the table 164.

To rotate the bending bar a trunion 170 (best seen in FIG. 7) is mounted to the bending bar 162. The trunion 170 has a generally L-shaped front and an arcuate back surface 170*a*. The L-shaped front of the trunion 170 cradles the bottom and back of the bending bar 162. A chain 172 is connected, at one end, to the forward bottom of the trunion, as at 174, and at its opposite end, to the end of a cylinder rod 176. The rod 176 is reciprocally moved by a cylinder 178. When the machine 110 is in a start position, the cylinder rod 176 is extended. When the cylinder is activated, as will be described below, the cylinder rod is retracted, thereby pulling on the chain 172. The chain then pulls the forward bottom end of the trunion rearwardly, causing the trunion, the bending bar, and the disc to rotate about the center of rotation CR. To maintain the chain on the trunion, the trunion is sized to have a width which will fit between the links of the chain, as can be seen in FIG. 7.

In operation, the machine 110 is initially in a start position, as seen in FIG. 5. A metal sheet is inserted in the mount 124 of the machine until it abuts the stop plate 166 above the bending bar plate 164. The operator then presses on the foot pedal, which, as described above, causes the nose bar to clamp down on the sheet metal to clamp the sheet metal between the nose bar and the table 114. When the upper and lower links 132 and 140 straighten out, the toggle stop bar 144 engages a start valve V1 mounted on the frame. The valve V1 activates the cylinder 178 to retract the cylinder rod 176 to rotate the bending bar to bend the sheet metal, as described above.

A stop arm 180 extends from the bottom of the bending bar (as seen in FIG. 5). As the bending bar pivots about the center of rotation, the stop arm 180 will pivot as well. The stop arm 180 includes a finger 182. The finger 182 is positioned, such that when the bend is complete, the finger will activate a reversing valve V2, shown mounted on the back of the lower link 140 of the clamping mechanism 130. When the valve V2 is activated, the cylinder 178 is activated to extend the cylinder rod 176. As can be appreciated, the chain 172 is flexible. Thus, the act of extending the cylinder rod 176 does not return the bending bar to its normal position. Rather, the bending bar returns to its normal position under its own weight, as acted upon by gravity. However if desired, springs could be provided to pull the bending bar back to its normal position.

When the clamping mechanism 130 is in its closed or clamping position, the links 132 and 140 are actually pivoted slightly over center to lock the clamping mechanism in its closed position. When the stop arm finger 182 engages the reversing valve V2, the stop arm finger also kicks the elbow 142 forward slightly to unlock the links 132 and 140, so that the springs 154 can act to raise the nose bar and return the clamping mechanism to its start position.

As various changes could be made in the above constructions without departing from the scope of the invention, it is intended that all matter contained in the above description or shown in the accompanying drawings shall be interpreted as illustrative and not in a limiting sense. The bender 62 and bending bar 162 could be rotated by means other than a cylinder. For example, the track could be provided with a toothed groove, and the block 64 could be provided with a motor driven gear that moves the bender along the track. With respect to the machine 110, the chain 172 could be gear driven, or connected to a pinion driven rack. The bending and reversing valves V1 and V2 would be replaced with switches which would then alter the rotation of the motor. The valves could also be mounted in different positions. Thus, for example, the valve V2 of machine 110 could be positioned to be activated by the bending bar 162, or by the cylinder rod 176. The toggle finger 25 of machine 10 could be fixed to the bender 62, rather than the toggle 22. In this position, the finger 25 would perform the same function, i.e., release the toggle 22 and link 26 from their locked position. Other means could be used to release the toggle and link from their locked position. For example, a solenoid operated pin, or a valve, could be used to push the toggle/link junction back over center when the bender has bent the sheet metal, or even after the bender has returned to its start position. The valves V1 and V2 would then be replaced with switches which would reverse the rotation of the motor when activated. The spool valve, which controls the direction hydraulic fluid through the cylinder can be controlled using other means. For example, limit valves can be replaced with a solenoid or other electronic control to alter the position of the spool valve. Additionally, the direction flow of hydraulic fluid through the cylinder can be controlled or reversed using means other than pneumatic limit valves and a spool valve. These examples are merely illustrative.

I claim:

1. A sheet metal bending machine comprising:

a housing having a mouth and a table adjacent the housing mouth;

a clamping mechanism comprising an elongate anvil positioned above said table and which is movable between a raised position in which sheet metal can be inserted in said clamping mechanism and a lowered position in which sheet metal is clamped between said anvil and said table: an upper fink pivotally mounted to said housing and a lower link pivotally connected to a lower end of said upper link; said anvil being operatively and pivotally connected to a lower end of said lower link; whereby the pivoting of said links relative to each other moves said anvil between its raised and lowered position: and a bending mechanism comprising an elongate bending bar and a drive; said bending bar being mounted in said housing to be pivotal between a start position in which said bending bar is substantially parallel to said table and a finished position in which said bending bar is pivoted upwardly; said drive being operable to move said bending bar from its start position to its finished position; wherein, when said bending bar is in its start position and said anvil is in its lowered position a forward edge of said bending bar is proximate a rearward edge of said anvil;

wherein said links pivot over center when said anvil is in its lowered position to lock said anvil in said lowered position; said bending bar operatively engaging said links when a bending operation is complete to move said links back over center to unlock said links and to allow said anvil to be moved back to its raised position.

2. The machine of claim 1 wherein an arm extends from said bending bar and a finger extends from said arm; said finger engaging said links proximate their pivot point when a bending operation is complete.

3. The machine of claim 1 wherein said upper link is angled and includes an upper section and a lower section joined at an angle; said angle defining a pivot point for said upper link; said machine including an arm extending from said upper link; said arm being sized and positioned relative to the link upper portion such that when the anvil is in its lowered position; the arm engages the bending bar; whereby, the bending bar pushes up against the arm when a bending operation is complete to unlock said links and to allow said anvil to return to its raised position.

4. The machine of claim 1 wherein said bending bar includes discs mounted at opposite ends of said bending bar; said housing including openings sized to rotatably receive said discs; said drive including a chain which is operatively connected to said bending bar such that when said chain is pulled, said chain causes said bending bar to pivot.

5. The machine of claim 4 wherein said discs do not form a complete circle.

6. The machine of claim 4 wherein said anvil is horizontally and vertically positioned such that the rear edge of said anvil is approximately aligned with the center of said housing openings.

7. The machine of claim 1 wherein said machine includes a curved track around said housing mouth: said track defining a path of travel for said bending bar.

8. The machine of claim 7 wherein the bending bar is mounted to a block; one of said block and said track having a groove, and the other of said block end track having a rib; said rib being received in said groove.

* * * * *

UNITED STATES PATENT AND TRADEMARK OFFICE

CERTIFICATE OF CORRECTION

PATENT NO. : 6,796,157 B2
DATED : September 28, 2004
INVENTOR(S) : Leo H. Stalzer It is certified that error appears in the above-identified patent and that said Letters Patent is hereby corrected as shown below:

Column 9,
Line 51, replace “fink” with -- link --

Signed and Sealed this

Seventh Day of June, 2005

JON W. DUDAS
*Director of the United States Patent and Trademark Office*